US010959519B2

(12) United States Patent
Kloth et al.

(10) Patent No.: US 10,959,519 B2
(45) Date of Patent: Mar. 30, 2021

(54) METHOD FOR INSTALLING A DRAWER ELEMENT AND CONSTRUCTION KIT FOR THE DISPLACEABLE MOUNTING OF A DRAWER ELEMENT, A PIECE OF FURNITURE, AND A DOMESTIC APPLIANCE

(71) Applicant: Paul Hettich GmbH & Co. KG, Kirchlengern (DE)

(72) Inventors: Thorsten Kloth, Hiddenhausen (DE); Ulrich Ratsch, Bad Salzuflen (DE); Michael Lehmkuhl, Georgsmarienhuette (DE); Eduard Arnst, Lemgo (DE); Peter Jaehrling, Buende (DE); Sebastian Bastkowski, Herford (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 0 days.

(21) Appl. No.: 16/311,755

(22) PCT Filed: Jun. 29, 2017

(86) PCT No.: PCT/EP2017/066076

§ 371 (c)(1),
(2) Date: Dec. 20, 2018

(87) PCT Pub. No.: WO2018/002191

PCT Pub. Date: Jan. 4, 2018

(65) Prior Publication Data

US 2019/0223594 A1 Jul. 25, 2019

(30) Foreign Application Priority Data

Jun. 29, 2016 (DE) ..... 10 2016 111 857.5

(51) Int. Cl.
*A47B 88/45* (2017.01)

(52) U.S. Cl.
CPC ..... *A47B 88/45* (2017.01); *A47B 2210/0059* (2013.01); *A47B 2210/0072* (2013.01); *A47B 2210/0083* (2013.01)

(58) Field of Classification Search
CPC ..... A47B 88/40; A47B 88/44; A47B 88/45; A47B 88/443; A47B 88/447;
(Continued)

(56) References Cited

U.S. PATENT DOCUMENTS 3,722,964 A * 3/1973 Chitester ..... A47B 88/493 384/18
5,484,199 A * 1/1996 Gasser ..... A47B 88/493 312/334.33

(Continued)

FOREIGN PATENT DOCUMENTS

CN 104323610 A 2/2015
CN 104453523 A 3/2015

(Continued)

OTHER PUBLICATIONS

International Search Report of PCT/EP2017/066076, dated Aug. 8, 2017.

(Continued)

*Primary Examiner* — Andrew M Roersma
(74) *Attorney, Agent, or Firm* — Collard & Roe, P.C.

(57) ABSTRACT

A method for installing a drawer and a construction kit for the displaceable mounting of a drawer element having a first and a second pullout guide, which are installable on opposing side walls, and a preinstalled device for synchronizing the movement of the movable rails of the two pullout guides using a cable pull. The side walls are preferably the side walls of furniture bodies or household appliances.

7 Claims, 30 Drawing Sheets

(58) Field of Classification Search
CPC .... A47B 2210/0059; A47B 2210/0064; A47B 2210/0072; A47B 2210/0078; A47B 2210/0083
See application file for complete search history.

(56) References Cited

U.S. PATENT DOCUMENTS

| | | | | |
|---|---|---|---|---|
| 5,564,807 | A * | 10/1996 | Rock | A47B 88/467 312/331 |
| 8,764,135 | B1 * | 7/2014 | Huang | A47B 88/447 312/333 |
| 9,341,011 | B2 | 5/2016 | Haab et al. | |
| 9,675,174 | B2 | 6/2017 | Jahrling et al. | |
| 10,058,176 | B2 * | 8/2018 | Rehage | A47B 88/45 |

FOREIGN PATENT DOCUMENTS

| | | | | |
|---|---|---|---|---|
| CN | 106016938 | A | 10/2016 | |
| DE | 102013113672 | A1 | 12/2014 | |
| WO | WO-2014198604 | A1 * | 12/2014 | |
| WO | WO-2015185557 | A1 * | 12/2015 | |
| WO | WO-2018159878 | A1 * | 9/2018 | A47B 88/40 |

OTHER PUBLICATIONS

German Search Report of Application No. 102016111857.5 dated Feb. 21, 2017 (with English translation of relative parts).
Chinese Office Action dated Jul. 3, 2020 issued in Chinese Application No. 201780038778.3 (with English translation).

* cited by examiner

METHOD FOR INSTALLING A DRAWER ELEMENT AND CONSTRUCTION KIT FOR THE DISPLACEABLE MOUNTING OF A DRAWER ELEMENT, A PIECE OF FURNITURE, AND A DOMESTIC APPLIANCE

CROSS REFERENCE TO RELATED APPLICATIONS

This application is the National Stage of PCT/EP2017/066076 filed on Jun. 29, 2017, which claims priority under 35 U.S.C. § 119 of German Application No. 10 2016 111 857.5 filed on Jun. 29, 2016, the disclosures of which are incorporated by reference. The international application under PCT article 21(2) was not published in English.

BACKGROUND OF THE INVENTION

The present invention relates to a method for installing a drawer and a construction kit for the displaceable mounting of a drawer element having a first and a second pullout guide, which are installable on opposing side walls, and a preinstalled device for synchronizing the movement of the movable rails of the two pullout guides using a cable pull. The side walls are preferably the side walls of furniture bodies or household appliances.

DE 10 2013 113 672 A1 discloses a pullout guide system, in which two pullout guides are installable on opposing side walls of a piece of furniture, wherein the movable rails of the pullout guides are coupled to one another via a device for synchronization. The device for synchronization in this case comprises deflection rollers on a middle rail of the pullout guide and holders to fix a cable pull on the stationary guide rails in the movable slide rail. This device for synchronization has proven itself per se, however, the installation is relatively complex, since a holder having deflection rollers has to be installed in the rear region of the middle rail by means of screws. Moreover, a locking element, which is inserted into grooves on a tensioning sleeve of a housing, has to be installed on a tensioning device to tension the cable pull. The problem exists here that inserting the locking element is only possible when the grooves are aligned, which is difficult in particular in poor light conditions. Moreover, the locking element can be removed from the tensioning device and can be lost. The installation of the cable pull having the individual cable pull sections is also comparatively complex, since every cable pull section has to be installed separately.

SUMMARY OF THE INVENTION

It is therefore the object of the present invention to provide a method for installing a drawer element and a construction kit for the displaceable mounting of a drawer element, which enable an installation in a simple manner and enable efficient transportation.

This object is achieved by a method having the features of claim 1 and a construction kit having the features of claim 6.

In the method according to the invention, firstly the two pullout guides are fixed on opposing sides and subsequently a device for synchronizing the movement of the movable rails of the two pullout guides is installed. In this case, a holder having at least one deflection element is plugged or latched onto each pullout guide and a cable pull is laid around a deflection roller already preinstalled on the pullout guide. Moreover, at least one rail of each pullout guide is then coupled via a connecting device to the cable pull and the tension of the cable pull is adjusted via a device for setting the cable tension. The installation can thus be performed with few steps, in particular without tools, since the holders having the at least one deflection element are plugged or latched on. Moreover, the cable pull can also be laid as a preinstalled unit around the deflection roller and plugged or latched on the rail via a connecting device. A pullout system having two pullout guides may thus be installed within a short time, to then be able to fix a drawer element on the pullout guides.

A slide, which is moved from an installation position into the fixed position, is preferably provided on at least one deflection element for setting the tension of the cable pull. Two tensioning sleeves preferably provided with multiple receptacles can be fixed in different positions in relation to the housing of the holder in this case using the slide. The number of components is thus reduced, by two tensioning sleeves being able to be fixed simultaneously on the housing using the slide. For easy installation, insertion bevels can be provided in this case on the slide and/or on the receptacles on the tensioning sleeve, which facilitate guiding of the slide in the receptacles.

The connecting device is preferably installed such that a holder fixed on the stationary guide rail and on the movable slide rail is provided, in which a coupling element connected in each case to two sections of the cable pull is insertable, in particular by locking or clamping. Two ends of a cable pull can then be installed simultaneously on a rail via the coupling element.

In the construction kit according to the invention, the installation of the device for synchronizing the movement of the movable rails is performed without tools on the two pullout guides. The two holders having the deflection elements are preferably plugged or latched on a rear region of a rail, in particular the middle rail. Moreover, setting of the cable tension can preferably be performed in one of the two holders via spring-loaded tensioning sleeves. The tensioning sleeves are then secured in the set position using a slide, which is insertable into a receptacle of a tensioning sleeve, in order to fix this on a housing of the holder in the desired position, wherein two tensioning sleeves can be fixed simultaneously via the slide. The construction kit can thus consist of three units, namely the two pullout guides and the device for synchronizing the movement of the movable rails, wherein the device can be installed without tools by way of only a few installation steps. The device for synchronization can secure a slide captively on the holder in this case, which slide is movable only between an installation position having displaceable tensioning sleeve and a fixed position having fixed tensioning sleeve. Moreover, a stop can be formed on the tensioning sleeve in order to fix the tensioning sleeve captively on the holder with the deflection element.

BRIEF DESCRIPTION OF THE DRAWING FIGURES

Figure 13A:
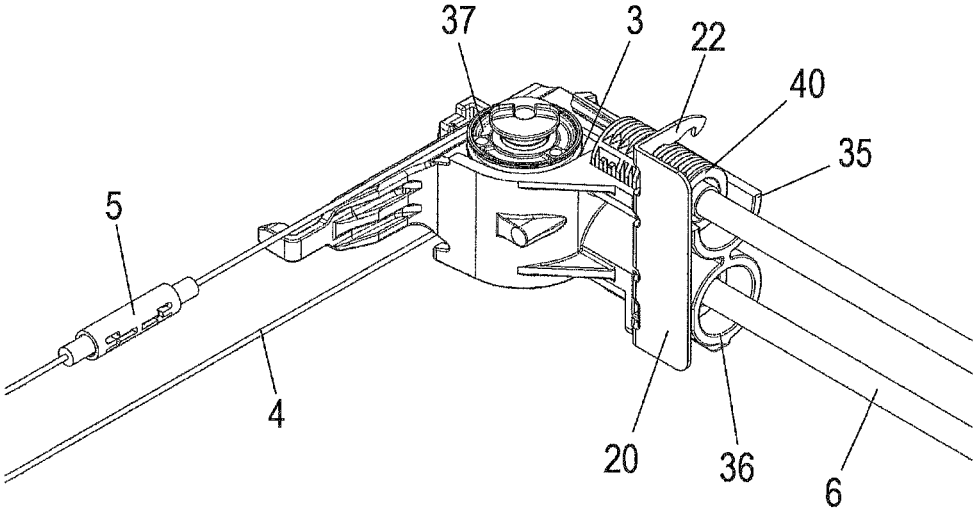
Figure 13B:
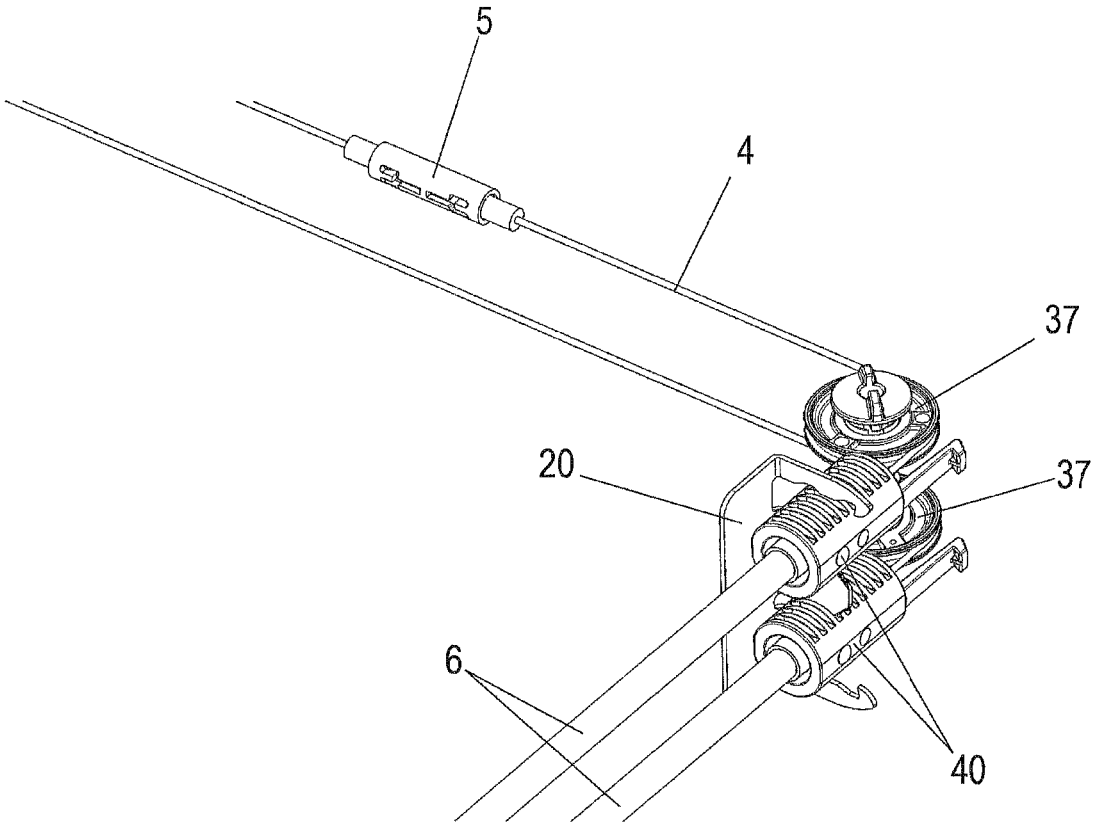
Figure 14:
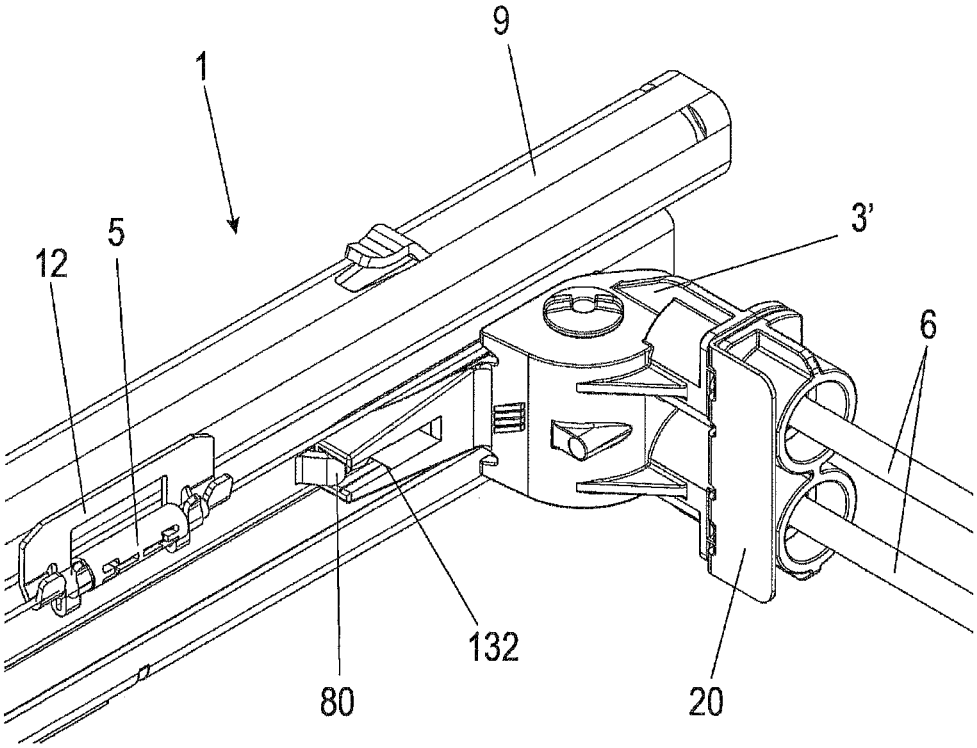
Figure 15A:
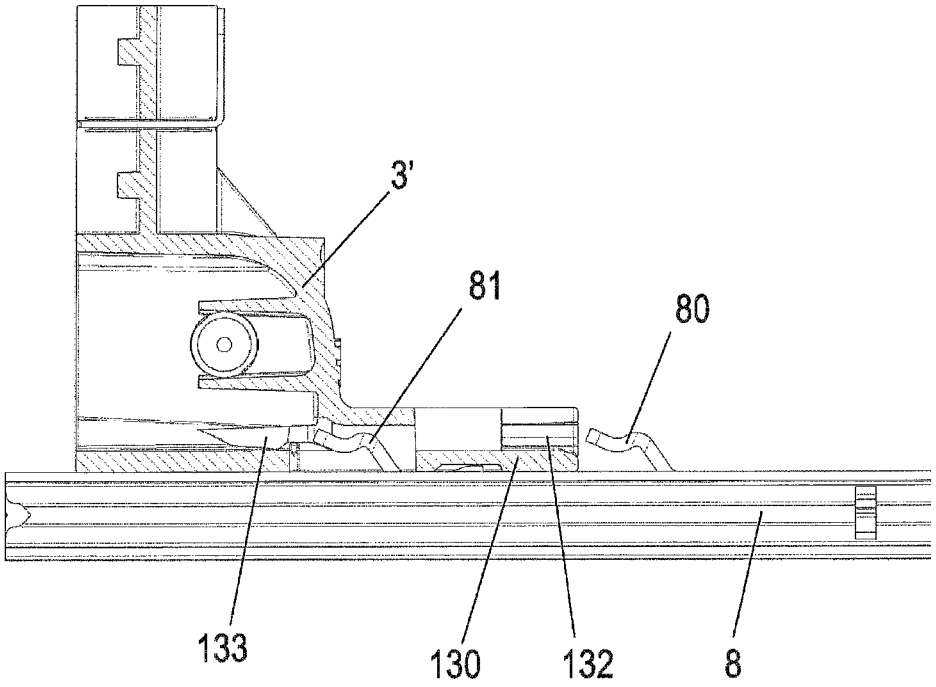
Figure 15B:
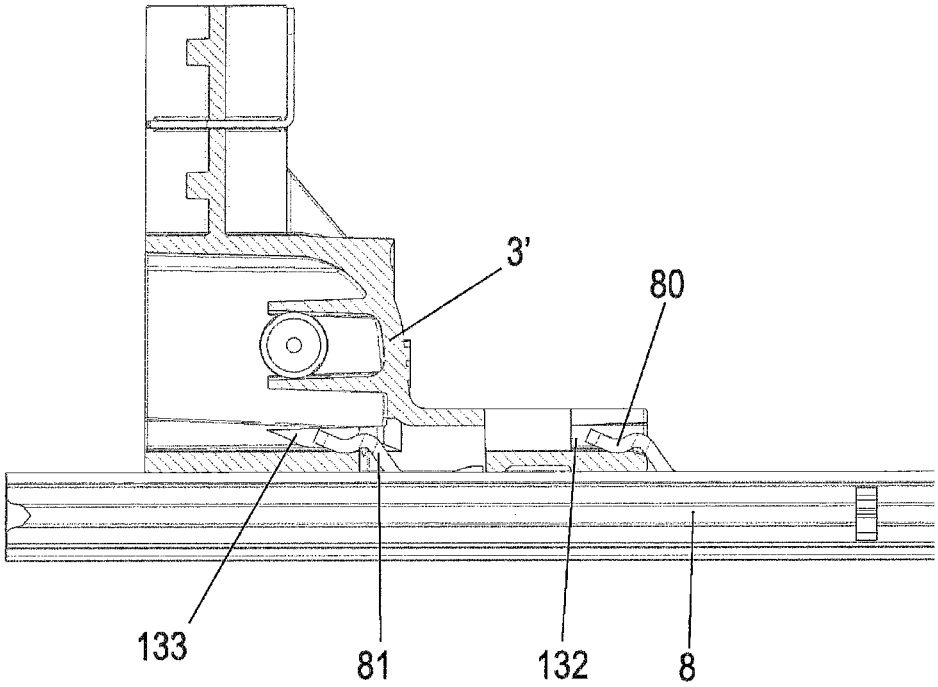
Figure 16A:
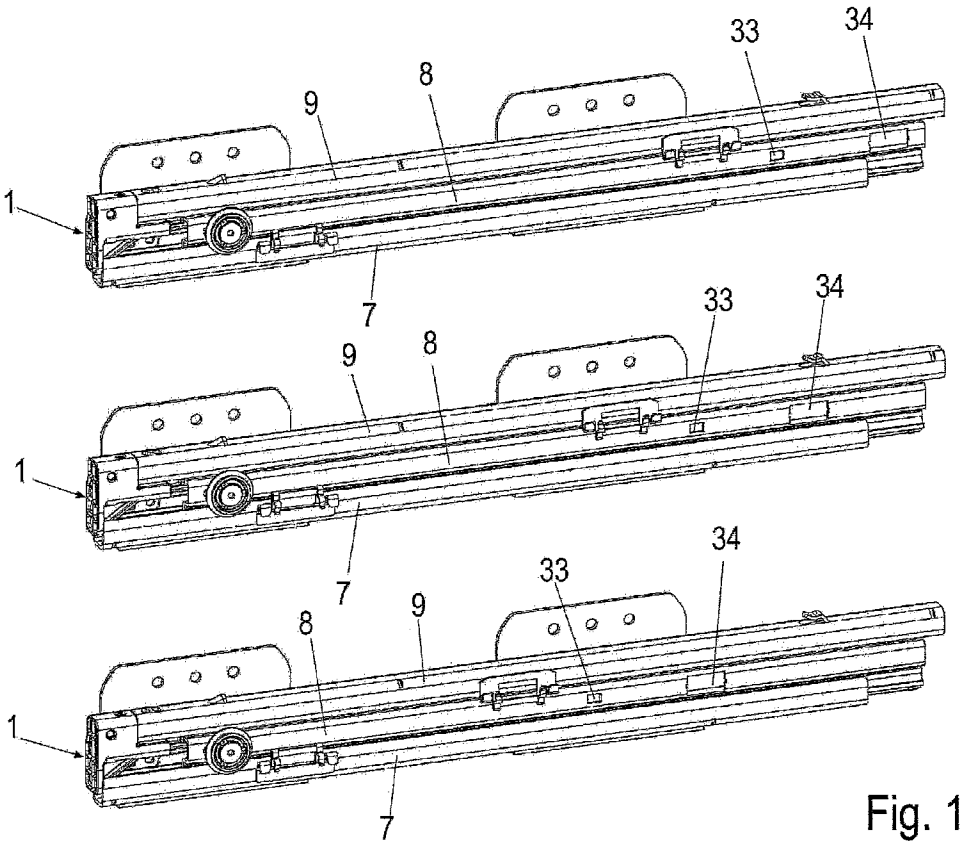
Figure 16B:
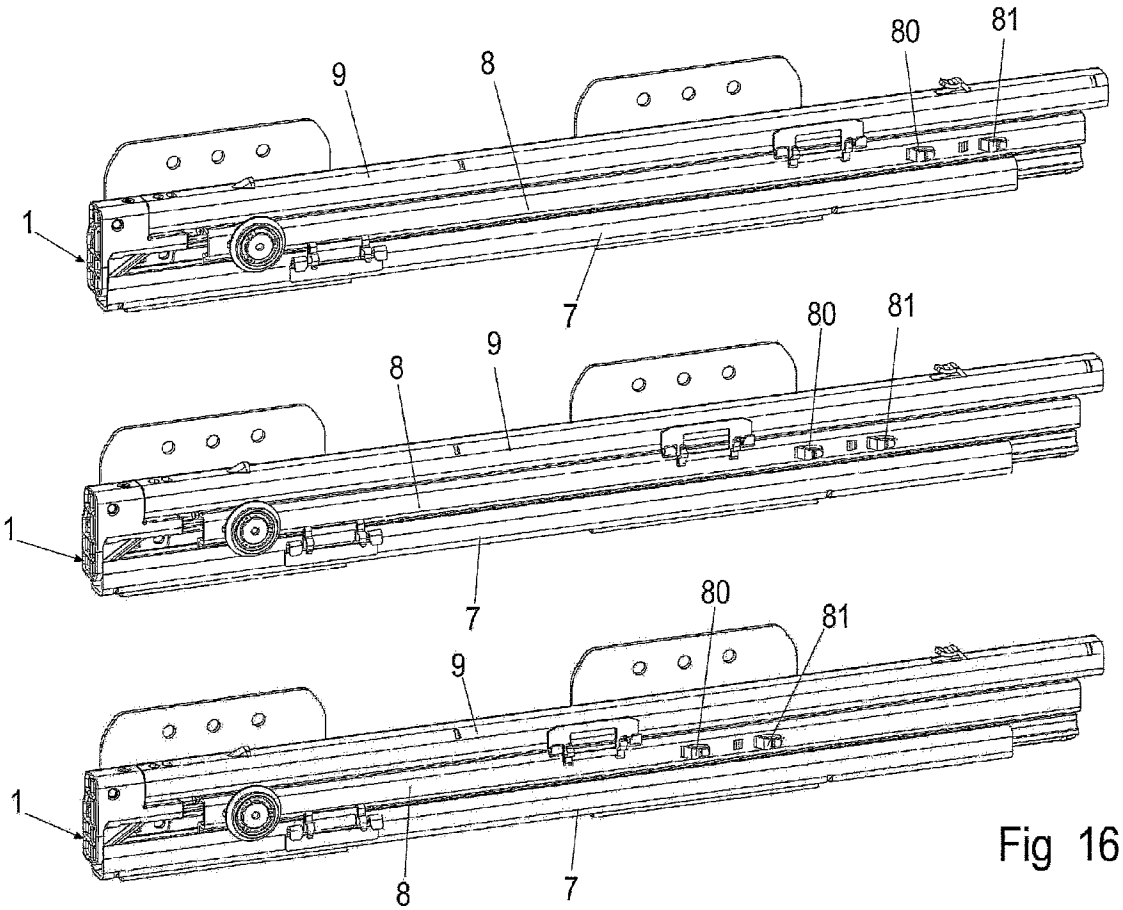

FIGS. 13A and 13B each show a perspective sectional illustration of the device for setting the cable tension with and without housing;

FIG. 14 shows a perspective view of a modified holder for a construction kit of FIG. 1;

FIGS. 15A and 15B show two views during the installation of the holder of FIG. 14; and FIGS. 16A and 16B show two views of the pullout guides having exemplary positioning options for the holder.

DETAILED DESCRIPTION OF THE INVENTION

A construction kit for the displaceable mounting of a drawer element comprises a first pullout guide 1, which is installable on a first side wall of a furniture body or a household appliance, and a second pullout guide 1, which is installable on an opposing side wall. In this case, each pullout guide 1 is fixable via installation angles 10 on the side wall. To synchronize a movement of the pullout guides, a device 2 is provided, which connects the two pullout guides 1 to one another. The device 2 for synchronizing the movement of the movable rails comprises two holders 3 having in each case at least one, preferably two deflection elements, in particular two deflection rollers, a cable pull 4, which can be produced from one or multiple cable pull sections, and coupling elements 5, to couple the cable pull 4 on the pullout guides 1. Furthermore, two sleeve-shaped jackets 6, which are part of a device for tensioning the cable pull 4, are arranged between the two holders 3.

Figure 1A:
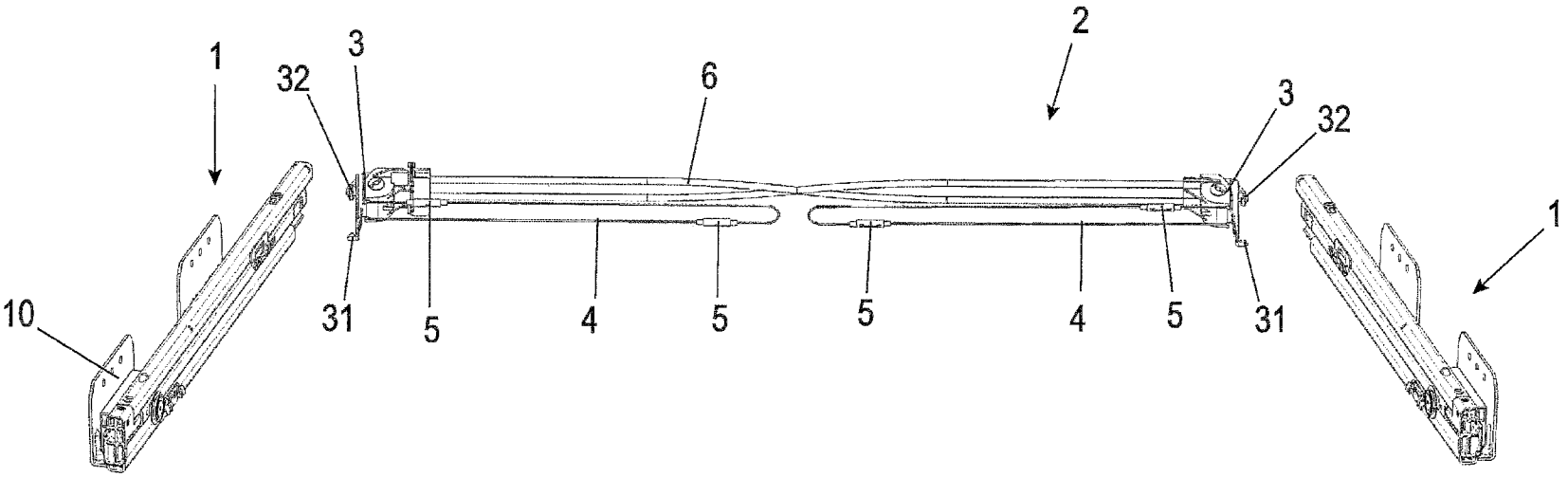
FIG. 1A shows a view of an exemplary embodiment of a construction kit for the displaceable mounting of a drawer before the installation.

The construction kit shown in FIG. 1A thus substantially consists of three units, namely the two pullout guides 1 and the device 2 for synchronizing the movement of the movable rails. The device 2 is shown in the installed position in FIG. 2B, wherein the installation is performed without tools.

Figure 1B:
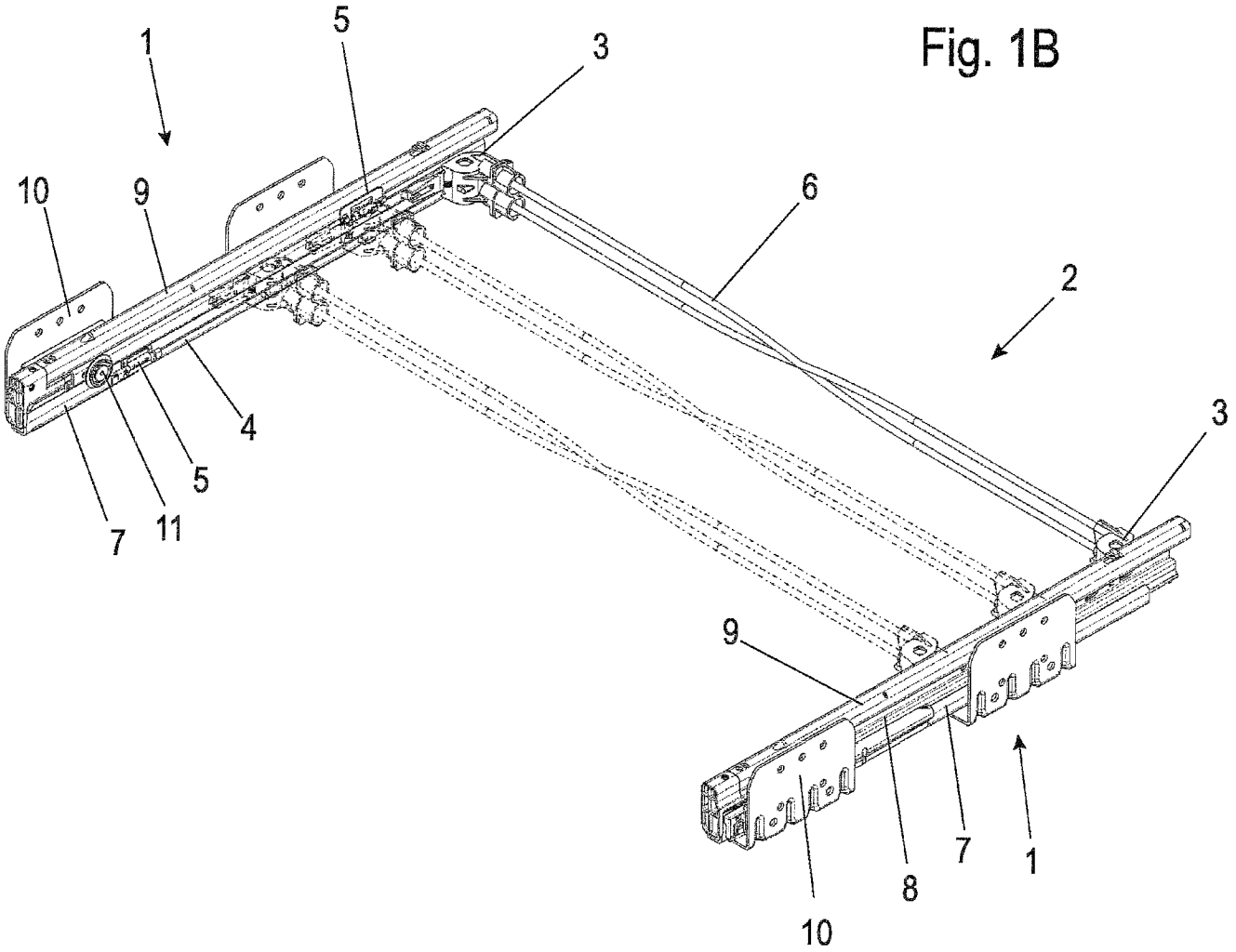
FIG. 1B shows a view of the construction kit of FIG. 1A after the installation.

FIG. 1B shows that the two holders 3 are fixed on a rear region of a middle rail 8 of each pullout guide 1. Each pullout guide 1 has a stationary guide rail 7 in this case, which is fixed on the installation angles 10, the middle rail 8, and a slide rail 9, which can be fixed on a drawer element, such as a drawer. Furthermore, a deflection roller 11, around which the cable pull 4 is guided, is mounted so it is rotatable on the middle rail 8 in the front region. The cable pull 4 is coupled in this case via a coupling element 5 to the stationary guide rail 7 and a further coupling element 5 to the slide rail 9. The cable pull 4 is designed to circulate and is guided by the coupling element 5 from the slide rail 9 of one pullout guide 1 via the two holders 3 to a coupling element 5 on the guide rail 7 of the other pullout guide 1, to be guided from there via the deflection roller 11 back to a coupling element 5 on the slide rail.

Figure 1C:
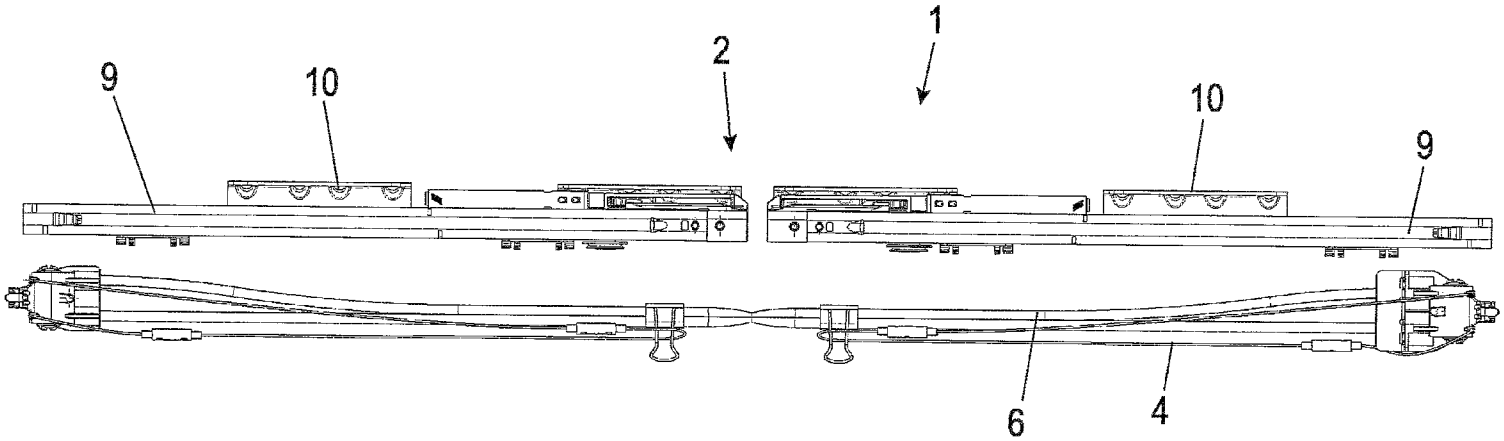
FIG. 1C shows a view of the construction kit of FIG. 1A in a transportation arrangement.

FIG. 1C shows that the construction kit can be arranged in a very space-saving manner for transportation and a very cost-effective transportation is thus implementable. This arrangement is not possible in the pullout guide of DE 10 2013 113 672 A1, since the device for synchronization is already connected to the pullout guide at the factory before the transportation.

Figure 2A:
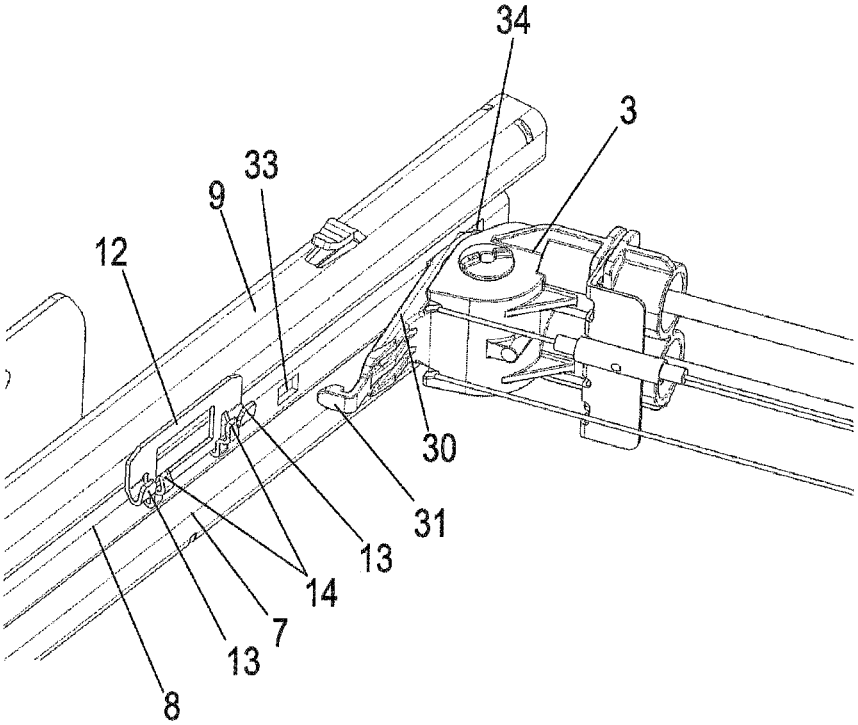
FIGS. 2A and 2B show two views during the installation of a holder of the construction kit of FIG. 1.
Figure 2B:
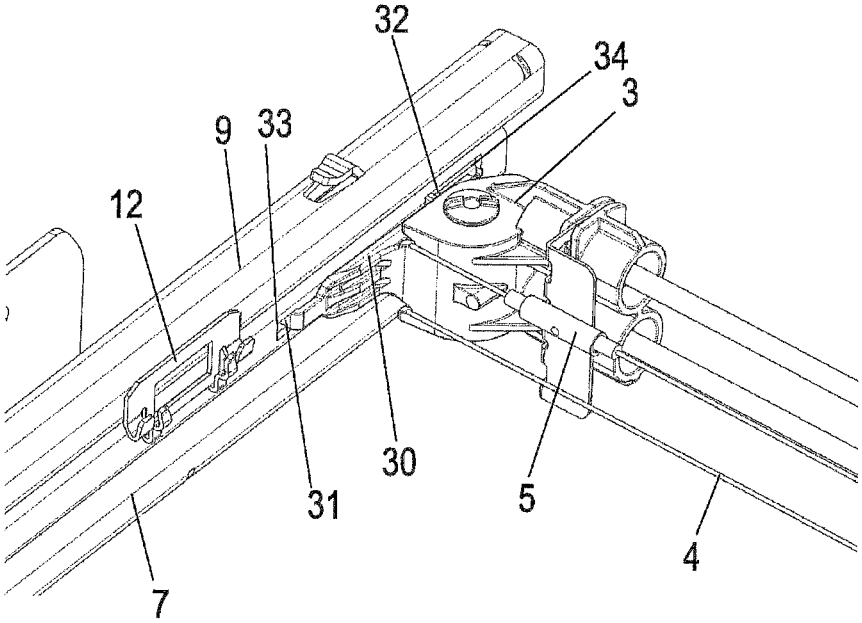

FIGS. 2A and 2B show the installation of a holder 3, which is installed on the middle rail 8. For this purpose, a contact web 30 of a housing having two protruding hooks 31 and 32 is positioned at openings 33 and 34 of the middle rail 8, wherein firstly the rear hook 32 is inserted into the opening 34 and then the front hook 31 is inserted into the opening 33. The hooks 31 are formed as catch hooks in this case and thus enable pivoting in and latching of the holder 3 on the middle rail 8 without tools.

Furthermore, a driver 12 is shown in FIGS. 2A and 2B, on which a coupling element 5 can be installed. The driver 12 has a section installed on the slide rail 9 or a guide rail 7, from which two holding webs 13 and two receptacle webs 14 protrude.

Figure 3A:
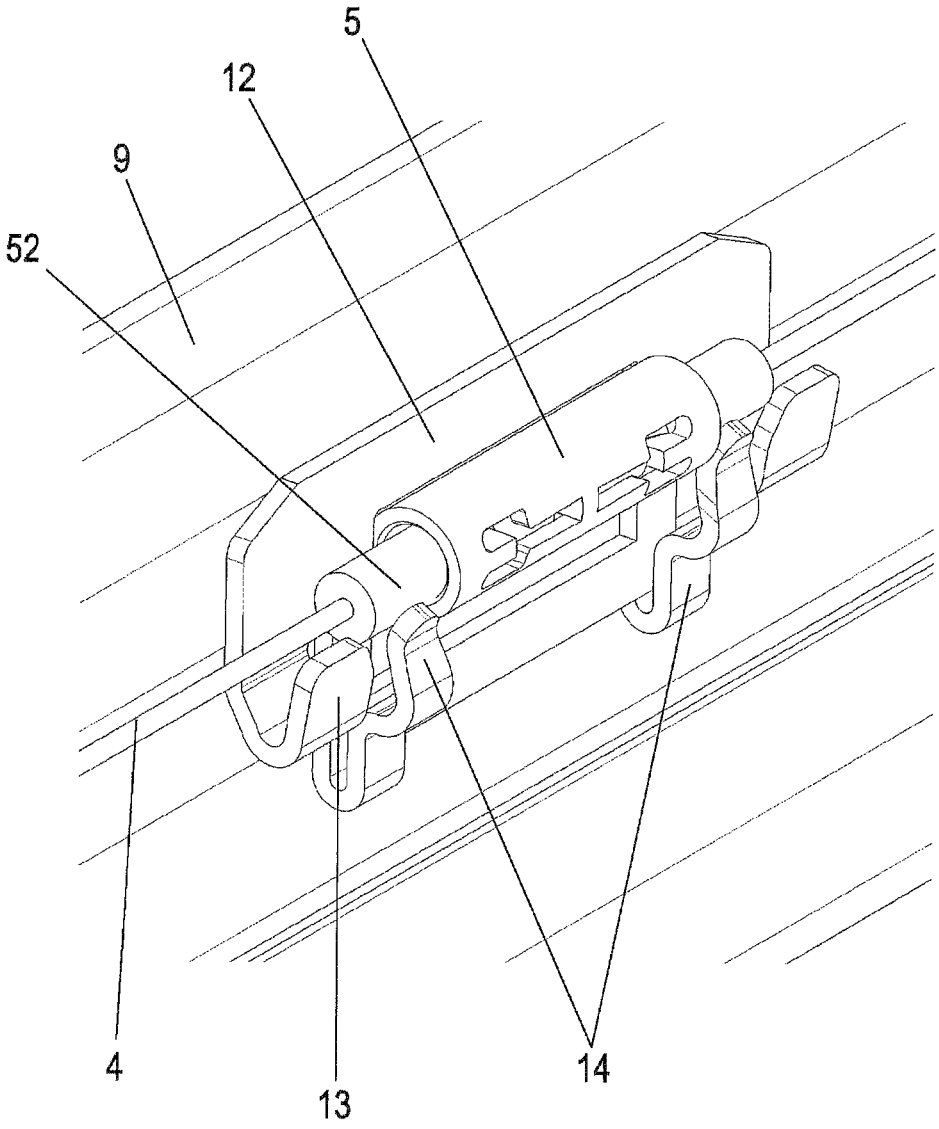
FIGS. 3A and 3B show two views during the installation of a coupling element of the construction kit of FIG. 1.
Figure 3B:
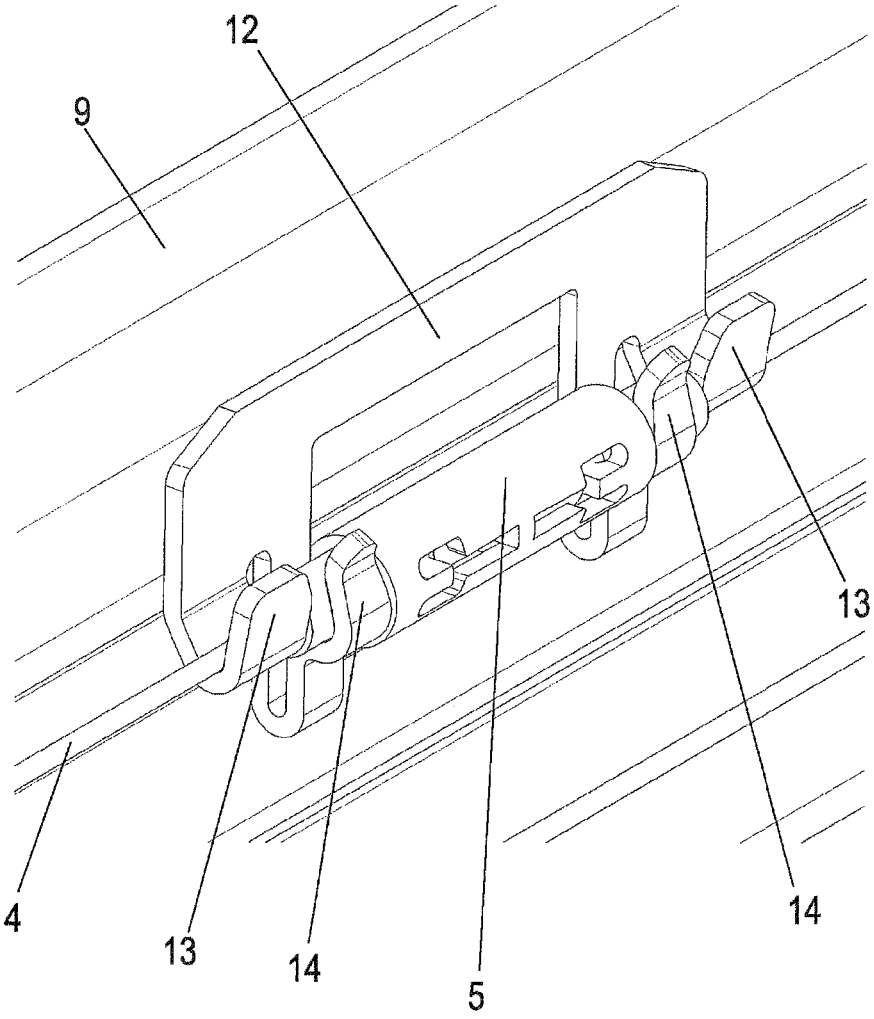

The driver 12 is shown enlarged in FIGS. 3A and 3B. During the installation of the cylindrical coupling element 5, it is inserted between the two receptacle webs 14, so that the coupling element 5 can be held immovably in the axial direction between the two receptacle webs 14. The receptacle webs 14 each enclose one cylindrical installation section 52 in this case, by means of which the cable pull 4 is fixed on the coupling element 5. The cylindrical installation sections 52 are arranged in the longitudinal direction of the cable pull 4 between the two holding webs 13 and are thus also secured against a movement in the longitudinal direction of the cable pull 4. The coupling element 5 can be plugged from above onto the receptacle webs 14, since the receptacle webs 14 and holding webs 13 form a U-shaped receptacle together with the driver 12. In the plugged-on position, the receptacle webs 14 enclose the cylindrical installation sections 52, as shown in FIG. 3B.

Figure 4A:
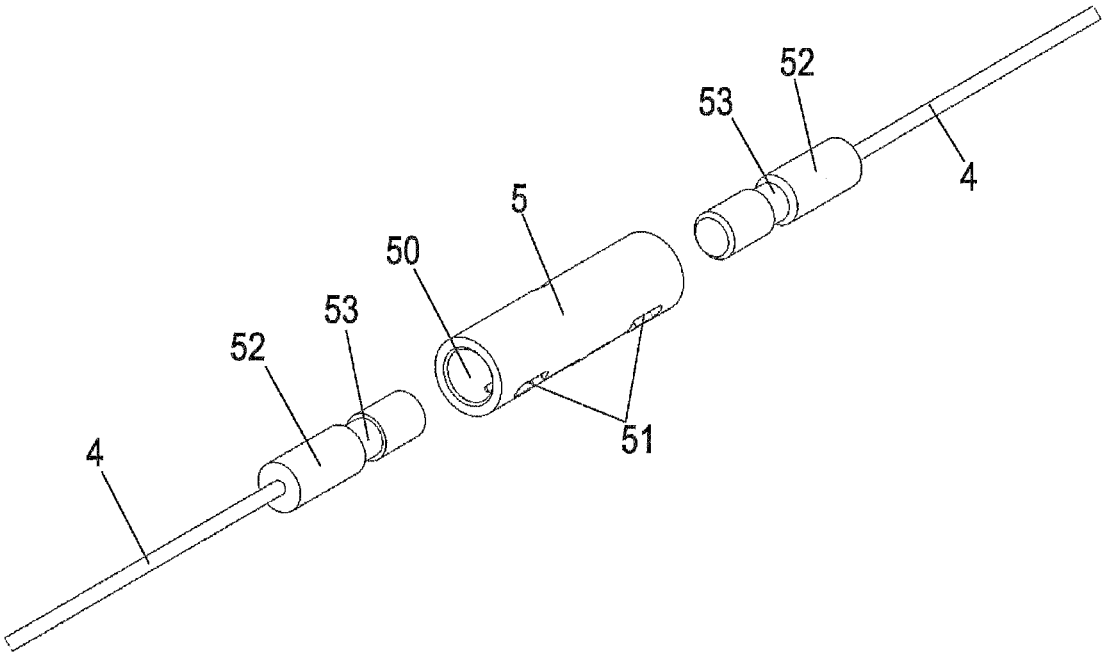
FIGS. 4A and 4B show two detail views of the coupling element of FIG. 3.
Figure 4B:
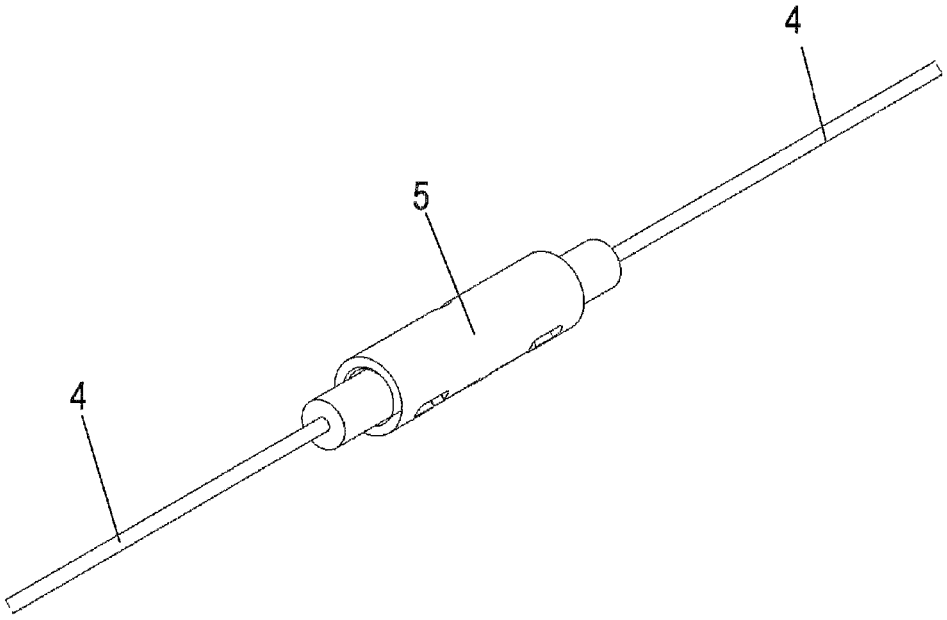

A coupling element 5 is shown in detail in FIGS. 4A and 4B, which has a cylindrical sleeve 50, which has multiple catch elements 51 formed on both sides. A cylindrical installation section 52, which is fastened on the cable pull 4, and on which a groove 53 is formed, is plugged into the cylindrical sleeve 50 on each of the two sides. The two installation sections 52 latch with the groove 53 on the respective catch element 51 of the sleeve 50 such that two sections of the cable pull 4 are connected to one another.

Figure 5:
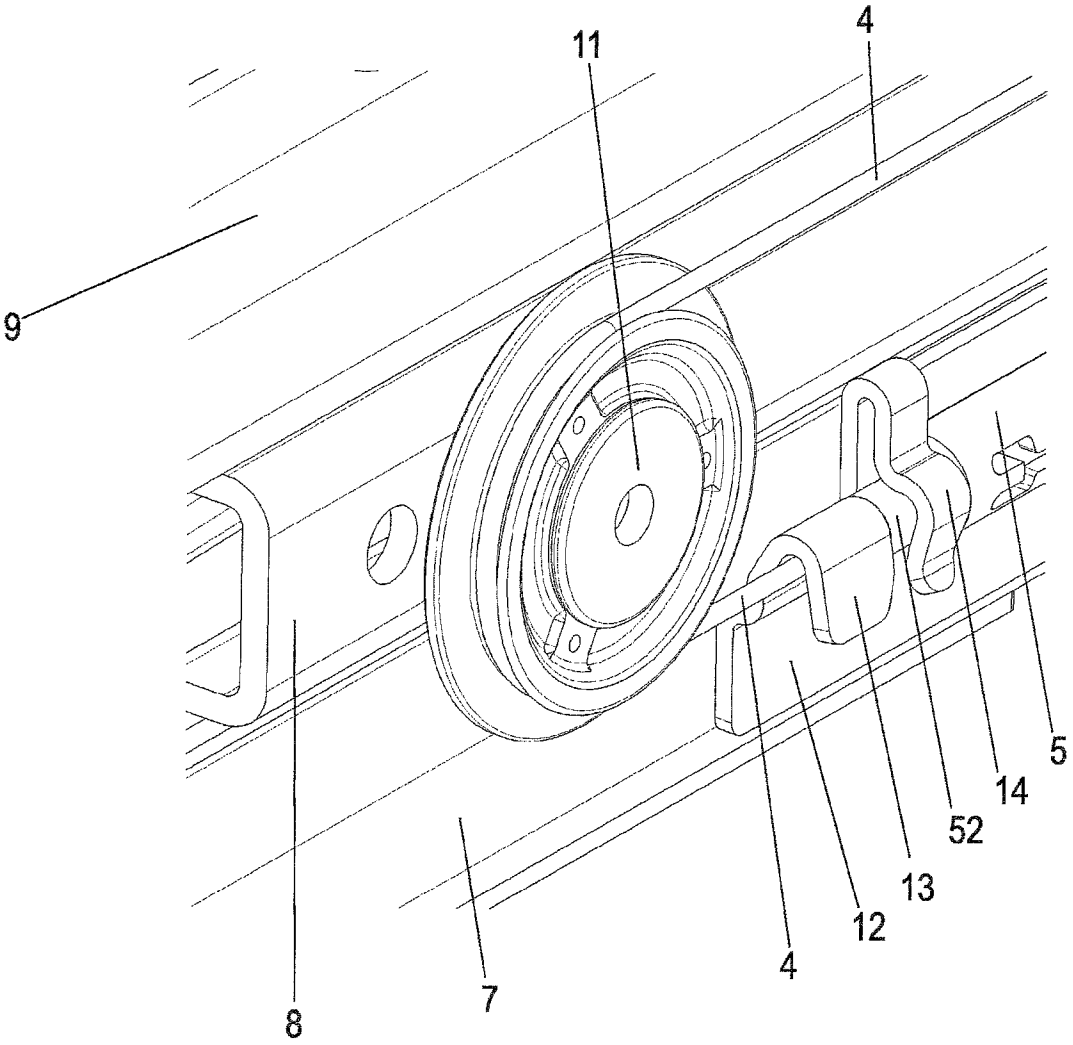
FIG. 5 shows a detail view of a deflection roller of the construction kit of FIG. 1 in the installed position.

The region of a deflection roller 11, which is arranged adjacent to a driver 12 on the guide rail 7, is shown in FIG. 5. The deflection roller 11 is mounted so it is rotatable on the middle rail 8 in this case and deflects the cable pull 4 by approximately 180°.

Figure 6:
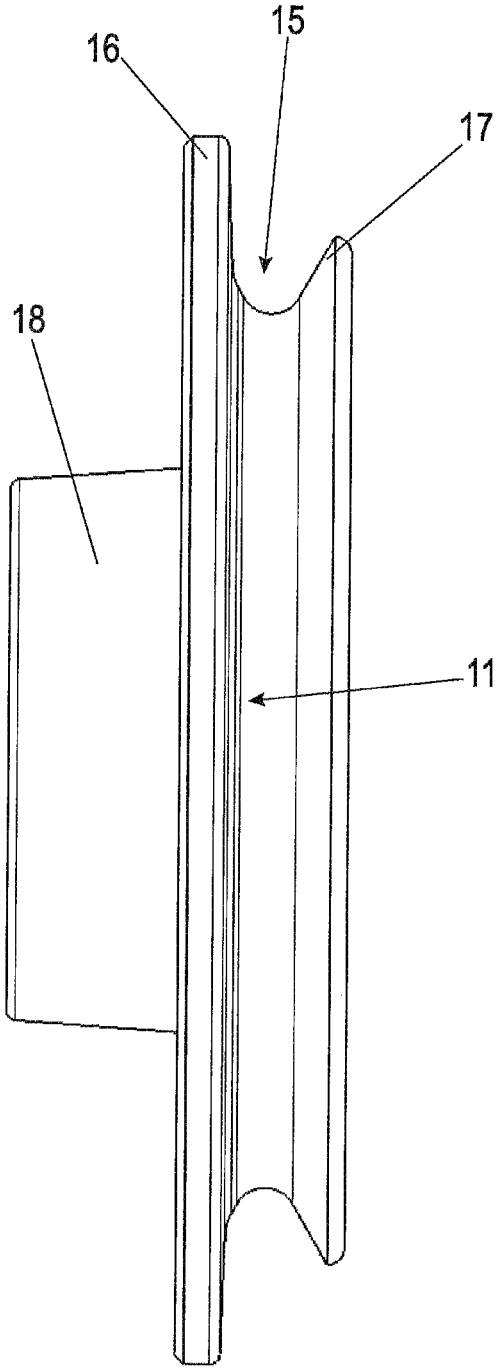
FIG. 6 shows a side view of the deflection roller of FIG. 5.

The deflection roller 11 is shown in detail in FIG. 6. The deflection roller 11 comprises a U-shaped receptacle 15 for the cable pull 4, wherein one side wall 16 is formed higher toward the middle rail 8 than an opposing side wall 17. The deflection roller 11 furthermore has a bearing section 18, which is plugged into the middle rail 8.

Figure 7A:
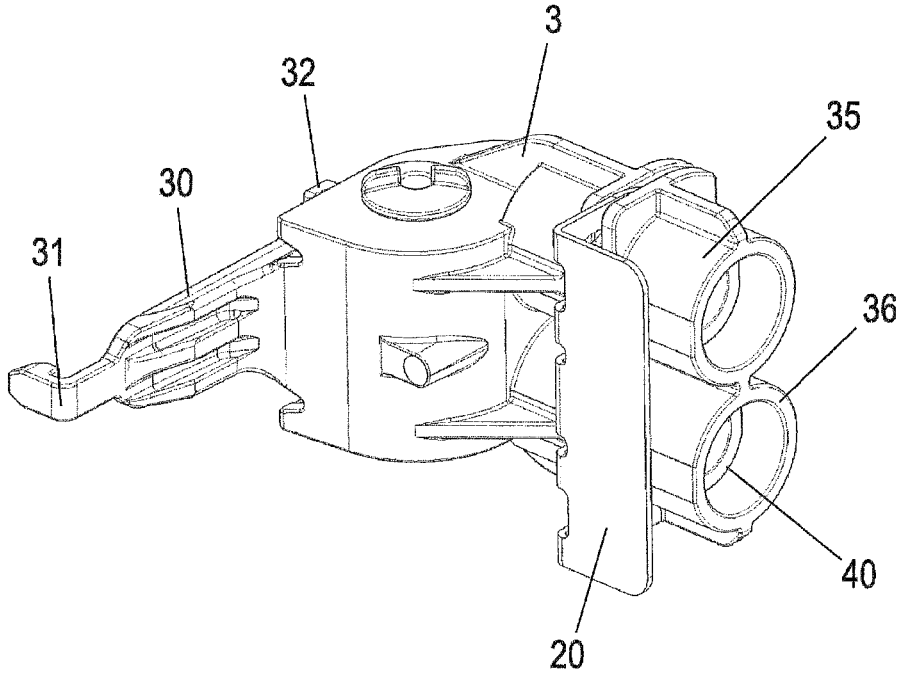
FIGS. 7A and 7B show two views of a device for setting the cable tension in the installation position.
Figure 7B:
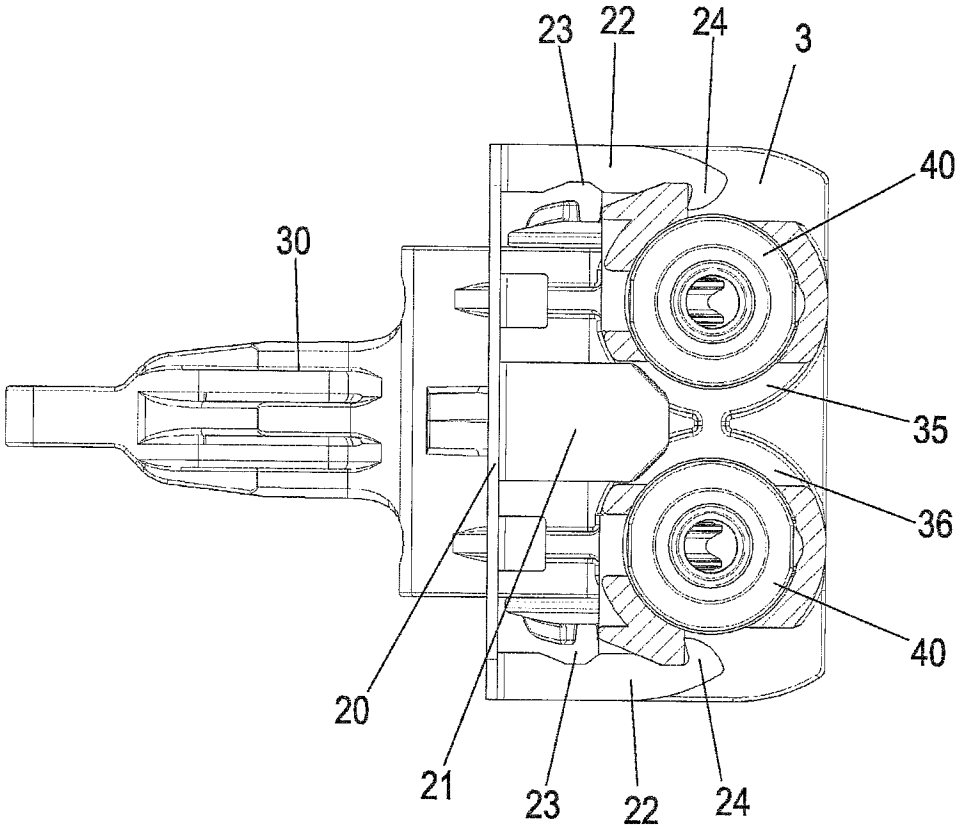

The holder 3, on which a device for tensioning the cable 4 is provided, is shown in FIGS. 7A and 7B. The holder 3 comprises a housing, on which the contact web 30 having the two hooks 31 and 32 is integrally formed. Furthermore, a slide 20 is provided on the holder 3, which is movable back and forth between two positions. The housing furthermore has two sleeves 35 and 36, in each of which a tensioning sleeve 40 is arranged, through which the cable pull 4 is guided. A section through the housing of the holder 3 is shown in FIG. 7B in this case, and it is recognizable that the slide 20 is arranged in an installation position, in which a sword 21 of the slide 20 is arranged spaced apart from the tensioning sleeves 40. The slide 20 comprises arms 22 having catch recesses 23 on opposing sides, wherein each arm 22 has an inwardly protruding stop 24, which ensures that the slide 20 is fixed captively on the holder 3.

Figure 8A:
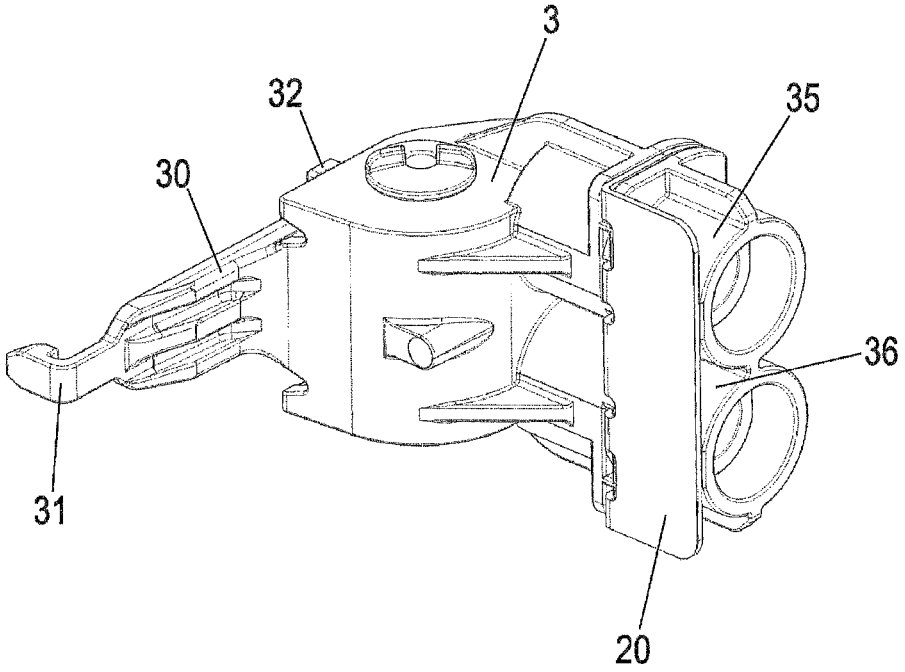
FIGS. 8A and 8B show two views of the device for setting the cable tension in the fixed position.
Figure 8B:
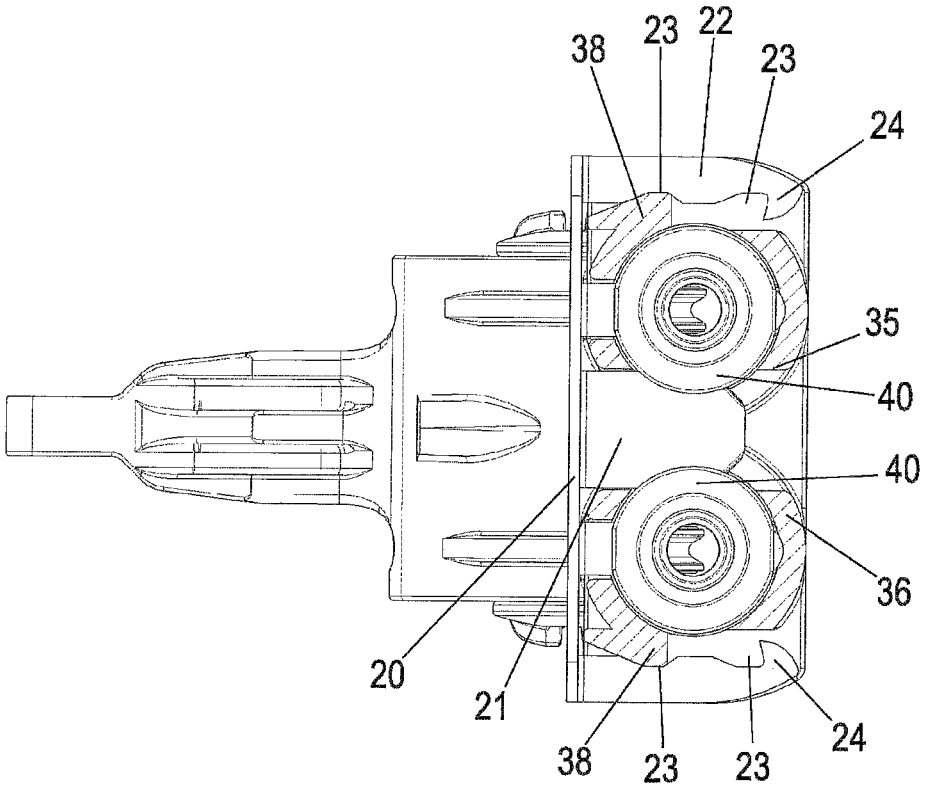

To move the slide 20 from the installation position having movable tensioning sleeve 40 into a fixed position, it is pushed into the holder 3, as shown in FIGS. 8A and 8B. By way of the pushing in, firstly the two arms 22 are unlocked from the first catch position and then pushed far enough into the holder 3 that a second catch recess 23 on the arm 22 engages with a catch projection 38 on the holder 3. In this case, the sword 21 on the slide 20 is also inserted between the sleeves 35 and 36, wherein one tensioning sleeve 40 is fixed in each of the sleeves 35 and 36 via the sword 21.

Figure 9A:
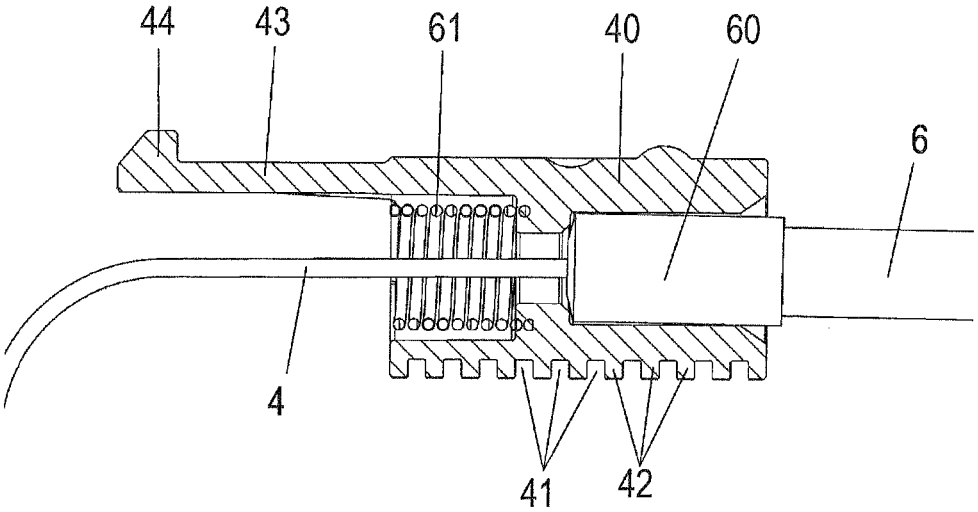
FIGS. 9A and 9B show two views of the device for setting the cable tension with the tensioning sleeve.
Figure 9B:
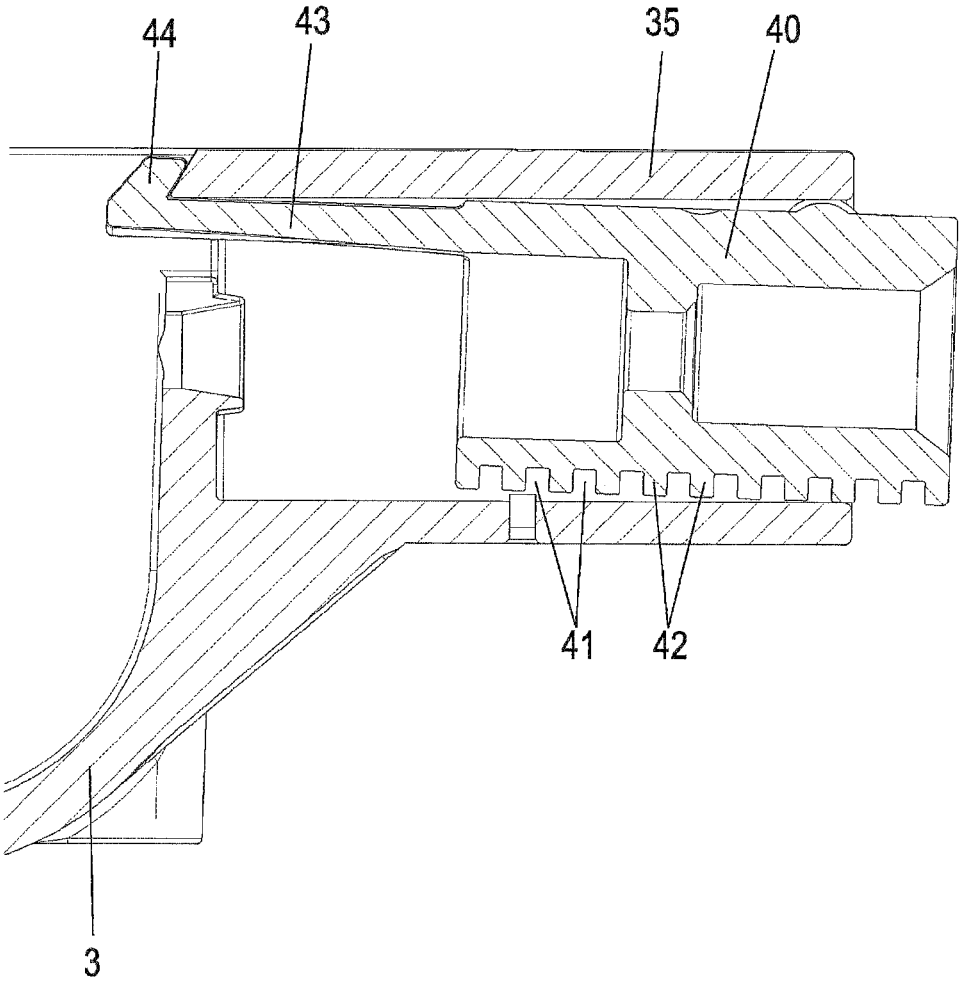

A tensioning sleeve 40, as is arranged in the sleeves 35 and 36 of the holder 3, is shown in FIGS. 9A and 9B. The tensioning sleeve 40 comprises an inner cavity, in which the cable pull 4 is guided through, and is pushed into an end piece 60 of the jacket 6. Multiple grooved receptacles 41, which are separated from one another via ribs 42, are formed on the outer side of the tensioning sleeve 40. The receptacles 41 are provided at least in the region of the sword 21, but can also be provided on other peripheral points. The tensioning sleeve 40 is pre-tensioned away from the holder 3 via a spring 61, wherein the maximum tensioning distance is predefined by a stop 44, which protrudes on an arm 43 of the tensioning sleeve 40. The stop 44 bears on the sleeve 35, as shown in FIG. 9B, so that the tensioning sleeve 40 can be pushed farther into the holder 3 from this position, but cannot be pulled farther out.

The tension of the cable pull 4 can be set via the position of the tensioning sleeve 40. The cable pull 4 is guided through the jacket 6, wherein in the event of a movement of one of the two tensioning sleeves 40, between which the jacket 6 is arranged, the route for the cable pull 4 in the jacket 6 remains constant, since it simply sags somewhat more strongly in the event of a shortening of the route. The cable pull 4 is tensioned when the tensioning sleeve 40 is moved out of the holder 3, and relaxed when the tensioning sleeve 40 is pushed into the holder 3 against the force of the spring 61. The tension of the cable pull 4 may be set by the spring 61, and installation tolerances can be compensated for.

Figure 10:
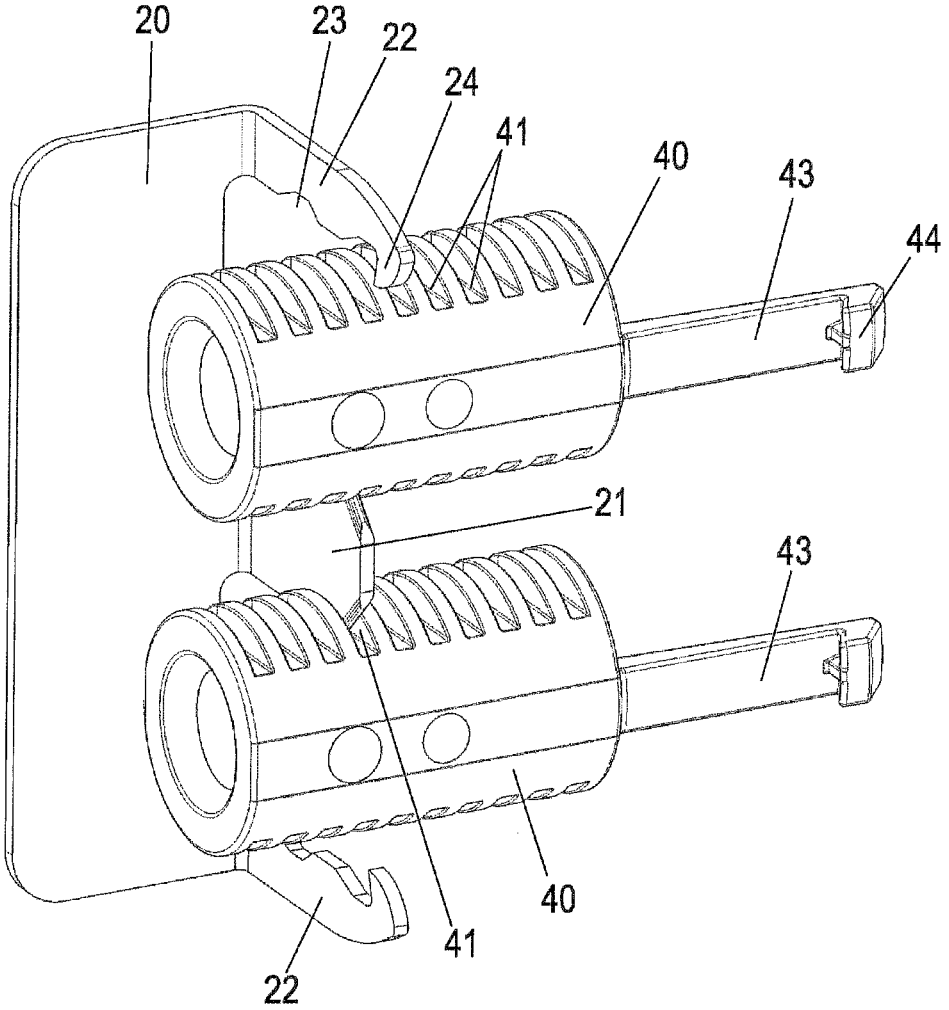
FIG. 10 shows a perspective view of the device for setting the cable tension without holder.
Figure 11A:
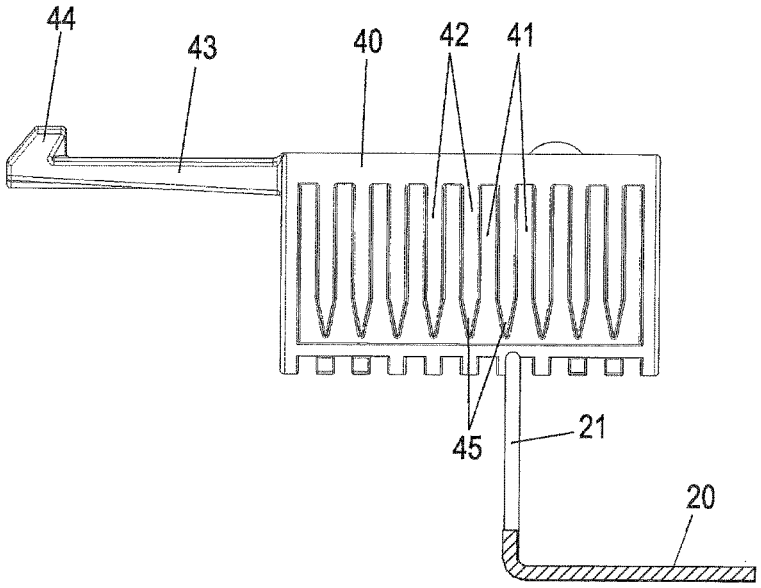
FIGS. 11A to 11D show multiple detail views of the device for setting the cable tension.
Figure 11B:
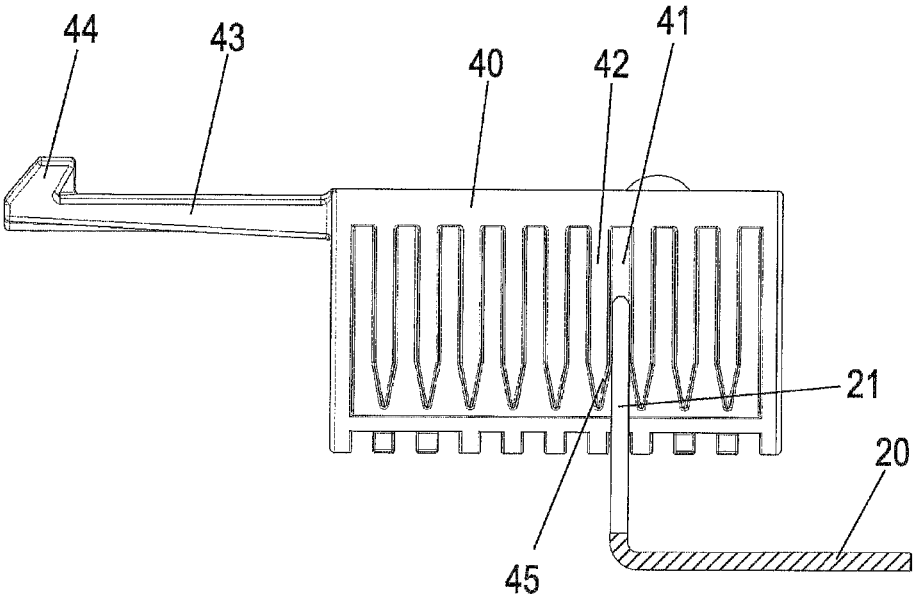
Figure 11C:
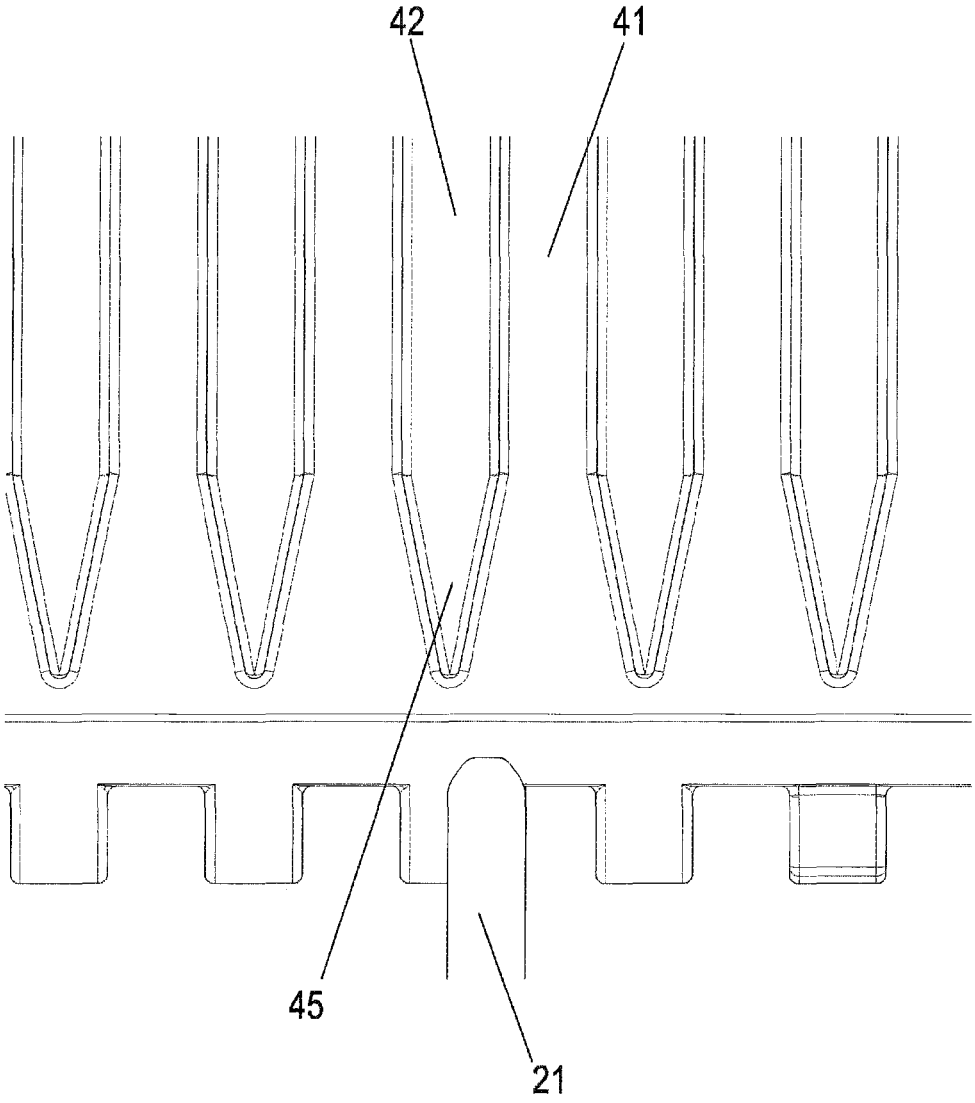
Figure 11D:
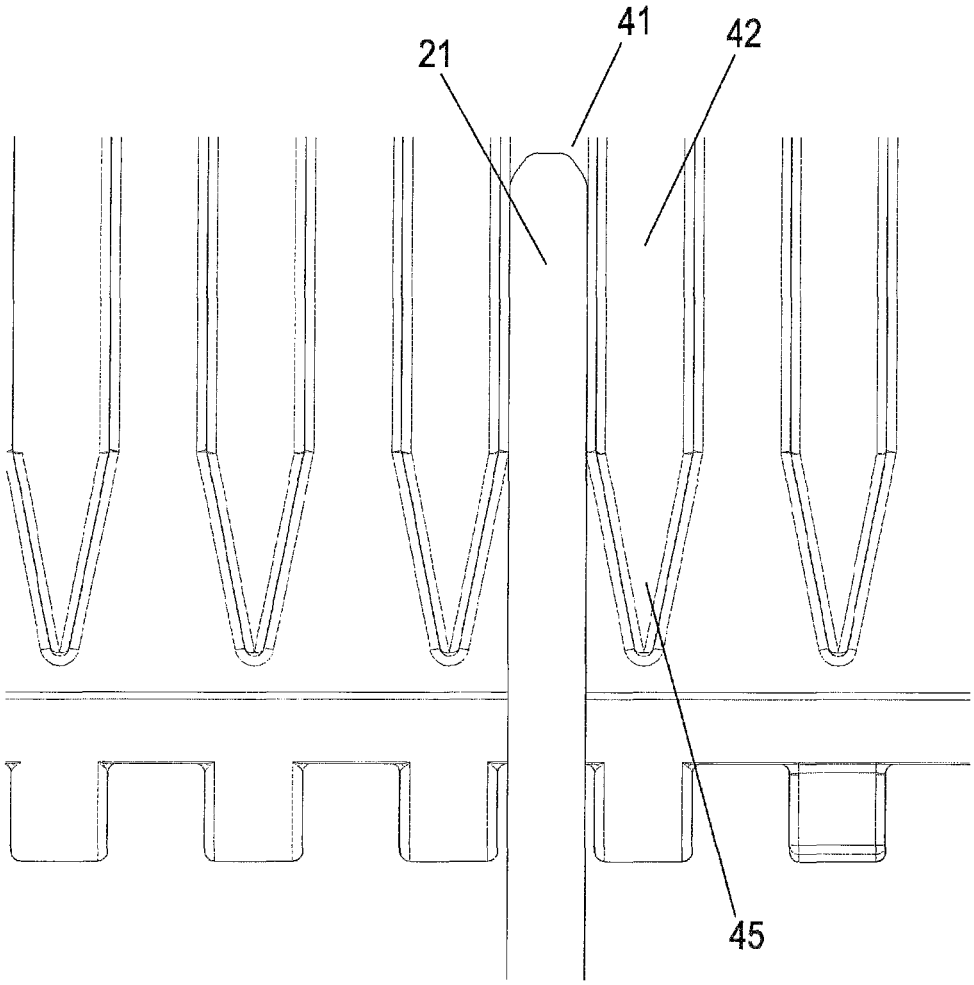

In FIG. 10, the slide 20 and the two tensioning sleeves 40 are shown without the housing of the holder 3. The slide 20 encloses the tensioning sleeves 40 in a U shape with the arms 22, wherein fixing of the tensioning sleeves 40 is performed via the middle sword 21, which is inserted into a grooved receptacle 41 of the tensioning sleeves 40. Therefore, the position of the two tensioning sleeves 40 can be fixed using a single slide 20.

FIGS. 11A to 11D show that the sword 21 is guided at tips by insertion bevels 45 upon insertion into the receptacle 41, so that independently of the position of the tensioning sleeve 40 in relation to the sword 21, a movement occurs into one of the receptacles 41. The sword 21 can then be inserted between two ribs 42 into the receptacle 41, which is arranged between two adjacent tips. The tensioning sleeves 40 can be moved independently of one another into the installation position in this case, so that after the setting of the tension of the cable pull 4, the slide 20 is moved into the fixed position in order to fix the two tensioning sleeves on the holder 3. During the installation, it does not have to be ensured exactly that the sword 21 is inserted into a receptacle 41, but rather it catches on its own in the corresponding receptacle 41 due to the insertion bevels 45.

Figure 12:
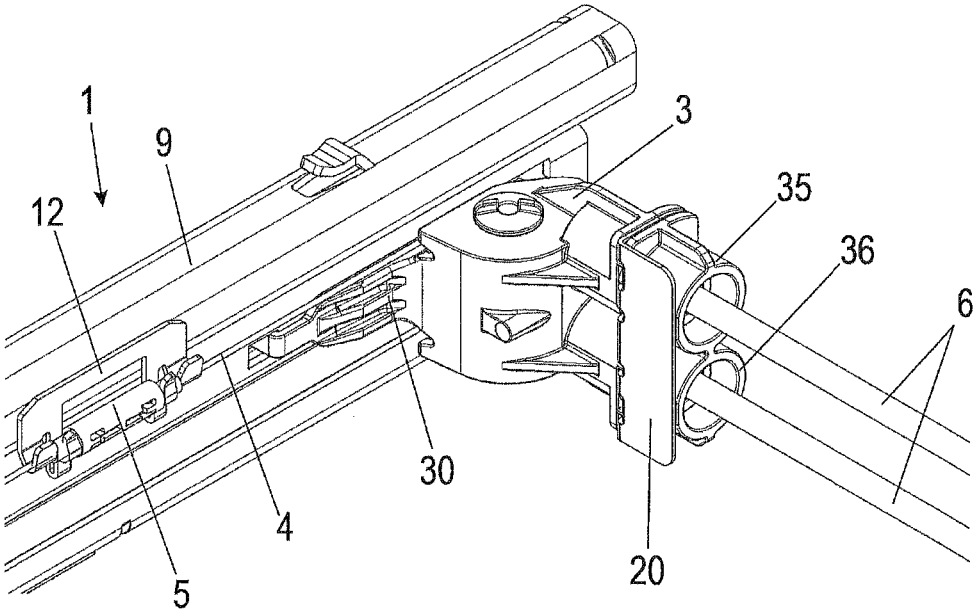
FIG. 12 shows a perspective view of the device for setting the cable tension in the installed position.

A holder 3 is shown in the fixed position in FIG. 12, in which the slide 20 is pushed in in order to fix the tensioning sleeves 40 in the sleeves 35 and 36. In FIG. 13A, a part of the housing of the holder 3 was omitted, and it is recognizable that the slide 20 secures the tensioning sleeves 40 in the sleeves 35 and 36 against a movement in the longitudinal direction of the cable pull 4. Furthermore, it can be seen that a deflection roller 37 is mounted so it is rotatable on the holder 3, to deflect the cable pull 4 by approximately 90°. In this case, two deflection rollers 37 are mounted so they are rotatable inside the holder 3, each of which deflects one section of the cable pull 4. The deflection roller 37 can be rotatable in this case about an axis which is provided on the holder 3.

FIG. 14 shows a modified exemplary embodiment of a holder 3', which is installed on a middle rail 8 of a pullout guide 1. The holder 3' comprises an installation section for fixing at hooks 80 and 81 on the middle rail 8, which has U-shaped receptacles 132, into each of which a hook 80 or 81 is insertable. The holder 3' is otherwise designed as in the preceding exemplary embodiment and comprises a slide 20 for setting the cable tension.

As shown in FIGS. 15A and 15B, the holder 3' is pushed onto the two hooks 80 and 81 of the middle rail 8, so that the hook 80 engages in the U-shaped receptacle 132 and secures a bottom section 130 between the hook 80 and the middle rail 8. In a similar manner, the hook 81 engages in a U-shaped receptacle 133, so that the holder 3' is fixed via the two hooks 80 and 81 on the middle rail 8.

FIG. 16A shows a pullout guide 1, which has a middle rail 8 having a front opening 33 and a rear opening 34. The openings 33, 34 are each arranged at different points on the middle rail 8.

The device 2 can thus be fixed at different positions on the middle rail 8 of the pullout guide, whereby an individual adaptation to the depth of the drawer element and/or the existing depth in installation space, in particular in the household appliance or in the furniture body, can be performed. In FIG. 16B, a pullout guide 1 similarly having a front hook 80 and a rear hook 81 is shown, wherein the hooks 80, 81 are arranged at different positions on the middle rail 8. The positions of the openings 33, 34 and/or the hooks 80, 81 on the middle rail 8 is solely by way of example and can vary. It is also possible to provide multiple openings 33, 34 and/or hooks 80, 81 at the same time on a middle rail 8, which are then only partially occupied during the installation.

LIST OF REFERENCE NUMERALS

1 pullout guide
2 device
3, 3' holder
4 cable pull
5 coupling element
6 jacket
7 guide rail
8 middle rail
9 slide rail
10 installation angle
11 deflection roller

12 driver
13 holding web
14 receptacle web
15 receptacle
16 side wall
17 side wall
18 bearing section
20 slide
21 sword
22 arm
23 catch recess
24 stop
30 contact web
31 hook
32 hook
33 opening
34 opening
35 sleeve
36 sleeve
37 deflection roller
38 catch projection
40 tensioning sleeve
41 receptacle
42 rib
43 arm
44 stop
45 insertion bevel
50 sleeve
51 catch element
52 installation section
53 groove
60 end piece
61 spring
80 hook
81 hook
130 bottom section
132 receptacle
133 receptacle

What is claimed is:

1. A method for installing a drawer element, having the following steps:

fixing a first pullout guide (1) on a first side wall and fixing a second pullout guide (1) on a second side wall, which is opposite to the first side wall, the pullout guides being equipped with movable rails (8, 9);

installing a device (2) for synchronizing movement of the movable rails (8, 9) of the first and second pullout guides (1), wherein a holder (3) having at least one deflection element is plugged or latched onto each said pullout guide (1);

laying a cable pull (4) around a deflection roller (11) provided on each said pullout guide (1);

coupling at least one rail (7, 8, 9) of each said pullout guide (1) via a connecting device (12) to the cable pull (4), setting tension of the cable pull (4) via a device for setting the tension of the cable pull, providing a single slide (20) on at least one said holder (3), the slide being formed from a base plate, two connecting arms extending from opposite ends of the base plate, and a sword extending between the connecting arms, wherein each said connecting arm has a first catch recess and a second catch recess, moving the slide (20) from an installation position into a fixed position to tension the cable pull (4), in order to apply a specific tension to the cable pull (4), wherein in the installation position the at least one said holder is inserted into the first catch recesses and in the fixed position, the at least one said holder is inserted into second catch recesses, and fixing two tensioning sleeves (40) in different positions in relation to a housing of the at least one said holder (3), the tensioning sleeves each being provided with multiple receptacles (41), by inserting a first of the connecting arms of the single slide into one of the receptacles on one of the tensioning sleeves, inserting a second of the connecting arms of the single slide into a first one of the receptacles in a second one of the tensioning sleeves, and inserting the sword between the tensioning sleeves so that the sword is inserted into one of the receptacles on each said tensioning sleeve, the connecting arms and the sword being inserted into the receptacles when moving the slide from the installation position to the fixed position, wherein each said connecting device (12) has a section fixed on a stationary guide rail (7) or on a movable slide rail (9), in which a coupling element (50) connected to two sections of the cable pull (4) is inserted in each case and wherein the coupling element (50) is inserted between two receptacle webs and held immovably in an axial direction between the two receptacle webs.

2. The method according to claim 1, wherein the slide (20) and/or the receptacles (41) comprise an insertion bevel (45) for facilitating the pushing of the slide (20) into the receptacles (41).

3. A construction kit for the displaceable mounting of a drawer element, having a first and a second pullout guide (1), which are installable on opposing side walls, and a preinstalled device (2) for synchronizing movements of movable rails (8, 9) of the first and second pullout guides (1), having a cable pull (4), and a holder with a housing, wherein the device (2) for synchronizing the movements of the movable rails (8, 9) is installable without tools on the first and second pullout guides (1), wherein the device (2) for synchronizing the movements of the movable rails has a device for setting cable tension and a single slide (20), the slide (20) being formed of a base plate, two connecting arms each extending from opposite ends of the base plate, and a sword extending between the connecting arms, wherein each said connecting arm has a first catch recess and a second catch recess, the single slide being configured to move between an installation position and a fixed position, wherein in the installation position the holder is inserted into the first catch recesses, and in the fixed position the holder is inserted into the second catch recesses, and wherein the slide is configured to fix two tensioning sleeves on a the housing simultaneously by pushing a first of the connecting arms of the single slide into a receptacle (41) on a first of the tensioning sleeves (40), pushing a second of the connecting arms of the single slide into a receptacle on a second of the tensioning sleeves and pushing the sword between the tensioning sleeves, so that the sword is fixed in a receptacle on each of the tensioning sleeves, and thereby fixes the tensioning sleeves (40) on the housing in a desired position, the connecting arms and the sword being pushed into the receptacles when the single slide moves from the installation position to the fixed position, wherein a connecting device (12) is provided on at least one rail (7, 9), on which a coupling element (5), which connects two ends of the cable pull (4) to one another, is configured to be plugged or latched, and wherein the coupling element (5) is inserted between two receptacle webs and held immovably in an axial direction between the two receptacle webs.

4. The construction kit according to claim 3, wherein the device (2) for synchronizing comprises two said holders (3) having deflection elements, and one said holder (3) can be latched or plugged on each said rail (8) in a rear region.

5. The construction kit according to claim 3, wherein a stop (44) is formed on each said tensioning sleeve (40), in order to secure the tensioning sleeve (40) captively on the holder (3).

6. A piece of furniture having at least one drawer element, which is synchronized in its movement by means of the construction kit designed according to claim 3.

7. A household appliance having at least one drawer element, which is synchronized in its movement by means of the construction kit designed according to claim 3.

* * * * *